US009079299B2

(12) United States Patent
Wu et al.

(10) Patent No.: US 9,079,299 B2
(45) Date of Patent: Jul. 14, 2015

(54) SWITCHING DEVICE FOR RATCHET WRENCH

(71) Applicants: Kuo-Hsien Wu, Taichung (TW); Kuan-Jen Hsieh, Taichung (TW); David Lee, Taichung (TW)

(72) Inventors: Kuo-Hsien Wu, Taichung (TW); Kuan-Jen Hsieh, Taichung (TW); David Lee, Taichung (TW)

( * ) Notice: Subject to any disclaimer, the term of this patent is extended or adjusted under 35 U.S.C. 154(b) by 374 days.

(21) Appl. No.: 13/737,912

(22) Filed: Jan. 9, 2013

(65) Prior Publication Data

US 2013/0180366 A1 Jul. 18, 2013

(30) Foreign Application Priority Data

Jan. 11, 2012 (TW) ..... 101200698 U

(51) Int. Cl.
*B25B 13/46* (2006.01)

(52) U.S. Cl.
CPC ..... *B25B 13/463* (2013.01)

(58) Field of Classification Search
CPC ..... B25B 13/46; B25B 13/463
See application file for complete search history.

(56) References Cited

U.S. PATENT DOCUMENTS

| | | | | |
|---|---|---|---|---|
| 7,263,918 | B1 * | 9/2007 | Chen | 81/63.1 |
| 7,313,987 | B1 * | 1/2008 | Chen | 81/63.1 |
| 8,210,073 | B2 * | 7/2012 | Hu | 81/63.1 |
| 2013/0152742 | A1 * | 6/2013 | Chen | 81/63.1 |
| 2013/0291688 | A1 * | 11/2013 | Hu | 81/63.1 |

* cited by examiner

*Primary Examiner* — David B Thomas

(57) ABSTRACT

A switching device of a ratchet wrench includes two engaging members respectively mounted to two rods of an operation member. The operation member has a polygonal shank which extends through the board of the head of the wrench and is connected with a switch. The operation member swings by pivoting the switch so as to control the either of the two engaging members to be engaged with the ratchet driving member. The operation member has a positioning tube, and a bead and a spring are located in the positioning tube. The bead is engaged with one of two recesses of a cover fixed to the head of the wrench when the operation member is pivoted. The cover has a flange on which a locking member is pressed. The locking member is engaged with a fixing portion in the inner periphery of the space.

6 Claims, 4 Drawing Sheets

SWITCHING DEVICE FOR RATCHET WRENCH

FIELD OF THE INVENTION

The present invention relates to a ratchet wrench, and more particularly, to a switching device for a ratchet wrench.

BACKGROUND OF THE INVENTION

The conventional ratchet wrench is disclosed in Taiwan Utility Model No. M267026 and comprises a switch unit, an engaging member and a driving member, wherein the switch unit, the engaging member and the driving member are accommodated in the space of the head of the wrench and a cover seals the opening of the head to positioning the parts therein. The engaging member has teeth which are engaged with the driving member. The switch unit has a base, a lever and a switch, wherein the base has threaded holes and a slot. The base is fixed to the hole of the switch by bolts. The slot in the base is in communication with the guide slot of the switch. An N-shaped resilient member is located within the guide slot, and one end of the resilient member is located in the slot of the base and the guide slot, and the other end of the resilient member is inserted into the restriction hole of the engaging member so as to move the engaging member.

However, because the tolerance formed during the manufacturing processes of the guide slot in the switch and the slot in the base, the resilient member may not be properly positioned so that the ratcheting feature may not be properly functioned. Besides, the tolerance makes the assembling of the ratchet wrench be difficult.

The present invention intends to provide a switching device for a ratchet wrench and the switching device improves the shortcomings mentioned above.

SUMMARY OF THE INVENTION

The present invention relates to a ratchet wrench and comprises a handle and a head connected to the handle. A board is connected to one side of the head and a space is defined in the head. A first hole and a second hole are defined through the board. A fixing portion is formed in the inner periphery of the space. A driving member has a cylindrical portion on one end thereof and a polygonal portion on the other end of the driving member. Multiple ratchet teeth are formed to the outer periphery of the driving member. The driving member is located in the space and the cylindrical portion is engaged with the first hole. Two engaging members are located in the space and each have teeth which are engaged with the ratchet teeth of the driving member. Each engaging member has a slot defined therethrough. An operation member is located in the space and has a shank extending from one end thereof. A first rod, a second rod and a positioning tube extend from the other end of the operation member. The first and second rods respectively extend through the two slots of the two engaging members. The first rod has a first positioning portion and the second rod has a second positioning portion. The first rod, the second rod and the positioning tube are located not sharing an axis of the shank. The shank extends through the second hole of the board. A switch has a connection portion and a lever. The switch is located on outside of the board and the shank is securely connected to the connection portion. Two resilient members are respectively in the slots, and each resilient member is biased between the first/second positioning portion and the inner periphery of the slot. A positioning unit has a spring and a bead. The spring is located in the positioning tube and the bead is biased by the spring. A cover is connected to the other side of the head to seal the space and has a flange on the periphery thereof. An accommodation hole is defined through the cover and the polygonal portion of the driving member extends through the accommodating hole. The cover has two recesses defined in the inside thereof, and the bead is engaged with one of the two recesses. A locking member is engaged with the fixing portion of the space and presses on the flange of the board.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
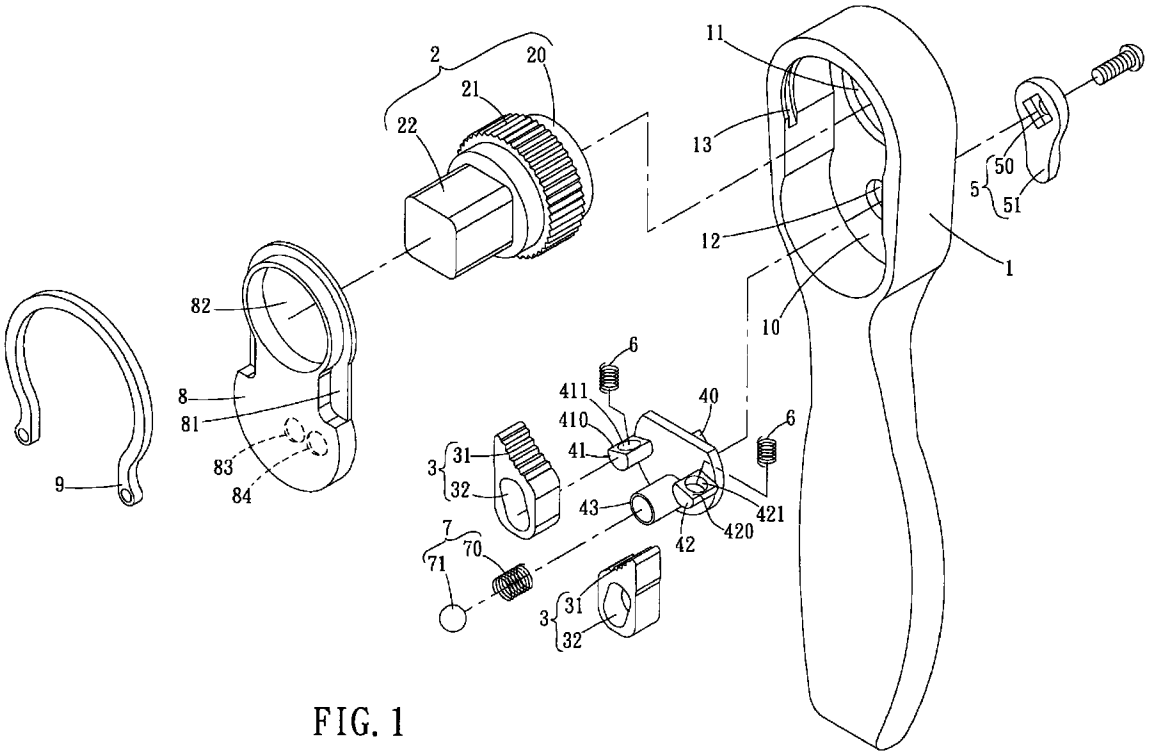
FIG. 1 is an exploded view to show the ratchet wrench of the present invention.

Referring to FIGS. 1 to 6, the ratchet wrench of the present invention comprises a handle and a head which is connected to the handle. A board is connected to one side of the head and a space 10 is defined in the head. The board has a first hole 11 and a second hole 12 defined therethrough. A fixing portion 13 is formed in the inner periphery of the space 10. In this embodiment, the fixing portion 13 is a groove.

A switching device comprises a driving member 2, two engaging members 3, an operation member 4, a switch 5, two resilient members 6, a positioning unit 7, a cover 8 and a locking member 9.

The driving member 2 has a cylindrical portion 20 on one end thereof and a polygonal portion 22 extends from the other end of the driving member 2 as shown In FIG. 1. The polygonal portion 22 is used to be cooperated with a socket which is not shown. The driving member 22 can also be the one shown in FIG. 6. Multiple ratchet teeth 21 are formed to the outer periphery of the driving member 2. The driving member 2 is a ratchet driving member which is known in the art. The driving member 2 is located in the space 10 and the cylindrical portion 20 is engaged with the first hole 11.

The two engaging members 3 are located in the space 10 and each have teeth 31 defined in an inclined top surface thereof and the teeth 31 are engaged with the ratchet teeth 21 of the driving member 2. Each engaging member 3 has a slot 32 defined therethrough which is an elongate slot or a curved slot.

The operation member 4 is located in the space 10 and has a shank 40 extending from one end thereof. In this embodiment, the shank 40 is a polygonal protrusion. A first rod 41, a second rod 42 and a positioning tube 43 extend from the other end of the operation member 4. The first and second rods 41, 42 respectively extend through the two slots 32 of the two engaging members 3. The first rod 41 has a first flat face 410 and the second rod 42 has a second flat face 420. A first positioning portion 411 is defined in the first flat face 410 and the second positioning portion 421 is defined in the second flat face 420. In this embodiment, the first and second positioning portions 411, 421 are two recesses. The first rod 41, the second rod 42 and the positioning tube 43 located not sharing the axis of the shank 40. The shank 40 extends through the second hole 12 of the board.

The switch 5 has a connection portion 50 and a lever 51, wherein the connection portion 50 is a polygonal recess. The switch 5 is located on outside of the board and the shank 40 is securely engaged with the connection portion 50 by extending a fixing member through the switch 5 and fixed to the shank 40. The two resilient members 6 are respectively located in the two slots 32 of the two engaging members 3. Each resilient member 6 is biased between the first/second positioning portion 411/421 and an inner periphery of the slot 32.

The positioning unit 7 has a spring 70 and a bead 71, the spring 70 is located in the positioning tube 43 and the bead 71 is biased by the spring 70.

The cover 8 is connected to the other side of the head to seal the space 10 and has a flange 81 on the periphery thereof. An accommodation hole 82 is defined through the cover 8 and the polygonal portion 22 of the driving member 2 extends through the accommodating hole 82. The cover 8 has two recesses 83, 84 defined in the inside thereof, the bead 71 is engaged with one of the two recesses 83, 84. The locking member 9 is engaged with the fixing portion 13 of the space 10 and presses on the flange 81 of the board 8. The locking member 9 is a C-shaped clip in this embodiment, a bolt, a bolt or a rivet can also be used as the locking member 9.

Figure 3:
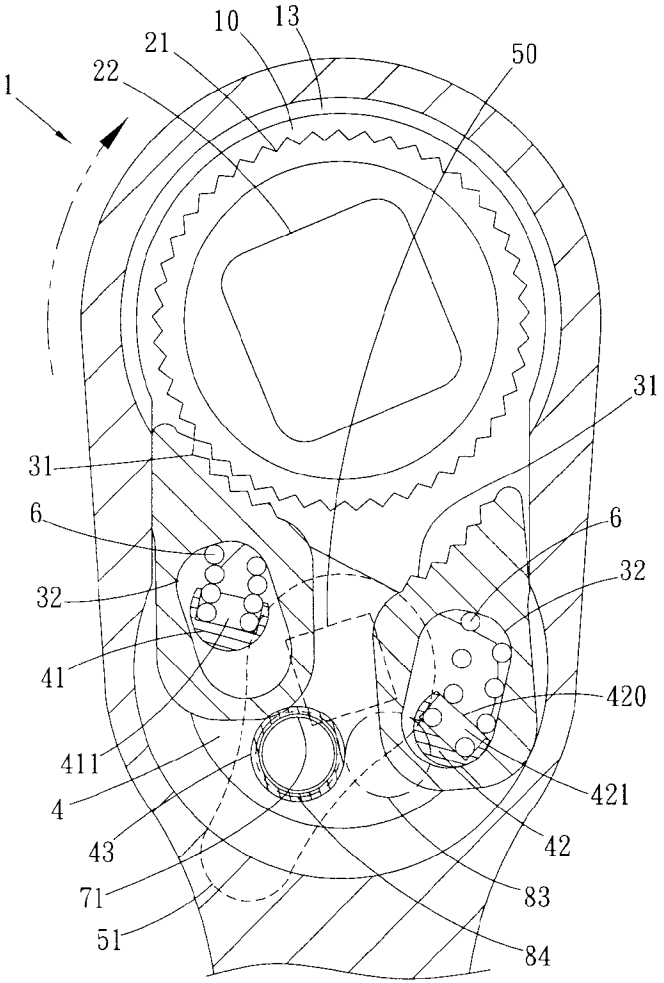
FIG. 3 is a cross sectional view to show that the left engaging member is disengaged from the driving member so that the ratchet wrench of the present invention is rotated clockwise and does not output torque.
Figure 2:
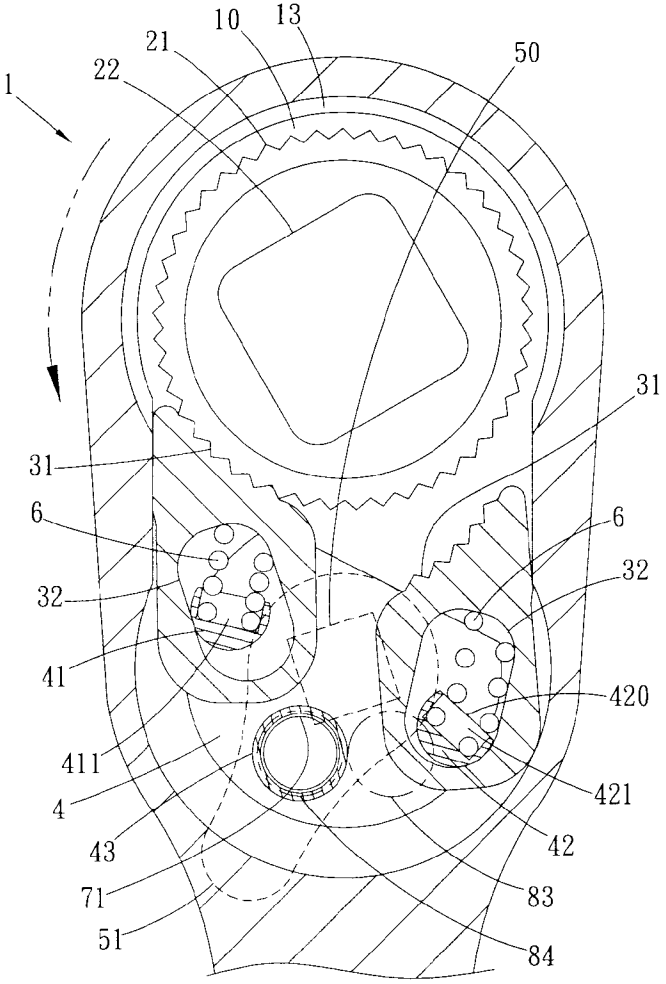
FIG. 2 is a cross sectional view to show that the left engaging member is engaged with the driving member so that the ratchet wrench of the present invention is rotated counter clockwise to output torque.

As shown in FIGS. 2 and 3, when the switch 5 pivots clockwise, the operation member 4 is pivoted clockwise so that the first and second rods 41, 42 are pivoted clockwise. The bead 71 is engaged with the recess 83 on the left. The second rod 42 pushes the engaging member 3 on the right to move downward so that the teeth 31 of the engaging member 3 on the right are disengaged from the ratchet teeth 21 of the driving member 2. In the meanwhile, the first rod 41 drives the resilient member 6 to push the engaging member 3 on the left move upward and the teeth 31 of the engaging member 3 on the left are engaged with the ratchet teeth 21 of the driving member 2. When rotating the ratchet wrench counter clockwise, the left wall of the space 10 contacts the outside of the engaging member 3 on the left, so that the teeth 31 of the engaging member 3 on the left are engaged with the ratchet teeth 21 of the driving member 2 as shown in FIG. 2. The driving member 2 is co-rotated with the rotation of the ratchet wrench 1 to output torque. On the contrary, When rotating the ratchet wrench clockwise, the left wall of the space 10 is separated from the outside of the engaging member 3 on the left, and the first rod 41 on the left compresses the resilient member 6 to separate the engaging member 3 on the left from the driving member 2, no torque is output as shown in FIG. 3.

Figure 5:
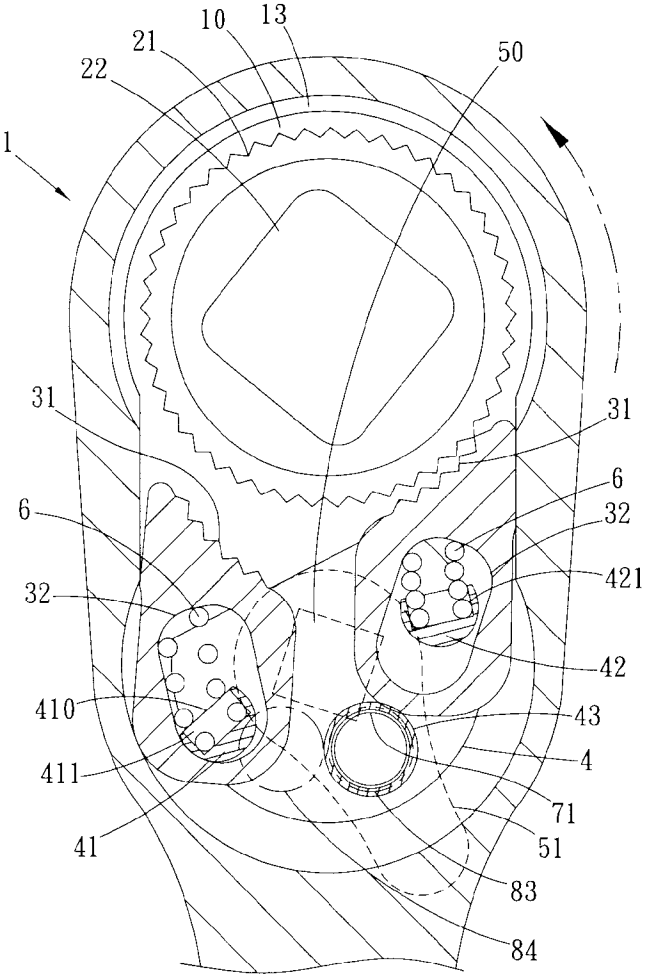
FIG. 5 is a cross sectional view to show that the right engaging member is disengaged from the driving member so that the ratchet wrench of the present invention is rotated counter clockwise and does not output torque.
Figure 4:
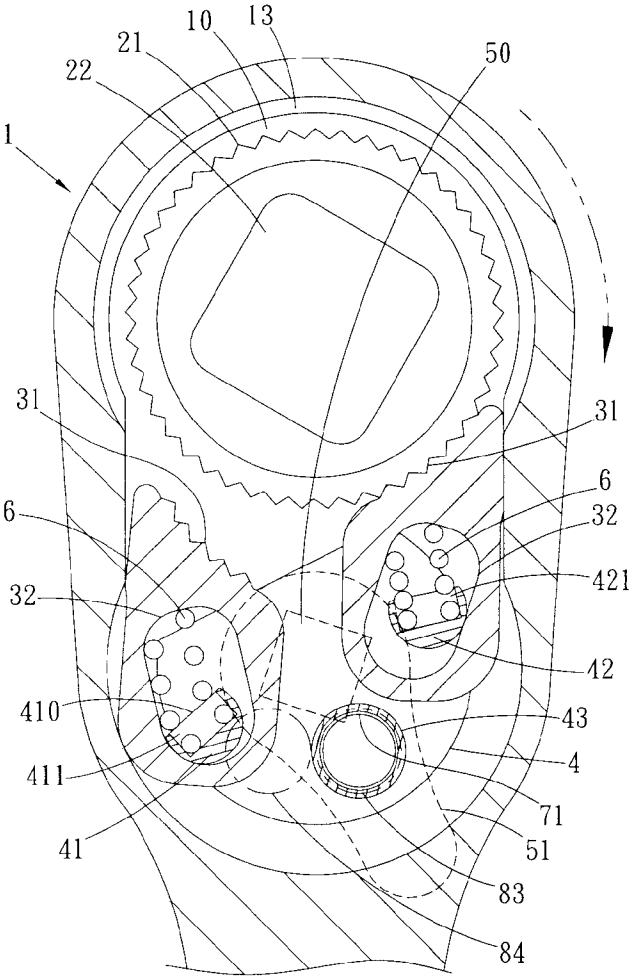
FIG. 4 is a cross sectional view to show that the right engaging member is engaged with the driving member so that the ratchet wrench of the present invention is rotated clockwise to output torque.
Figure 6:
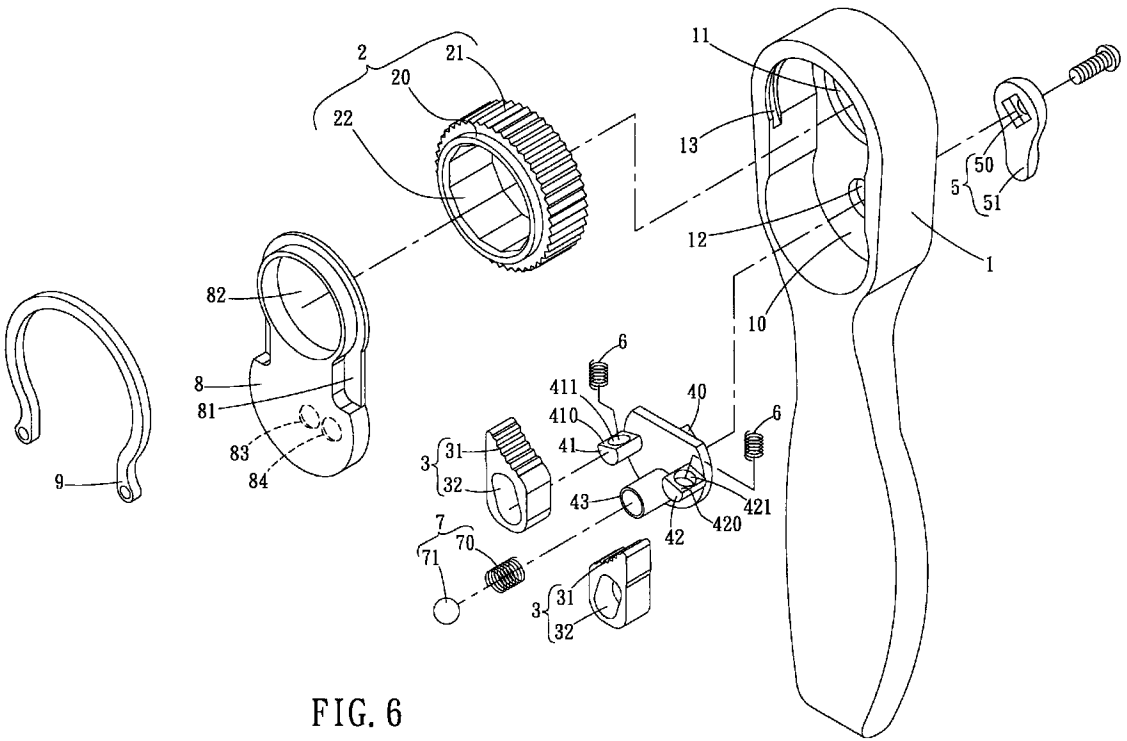
FIG. 6 is an exploded view to show the second embodiment of the ratchet wrench of the present invention.

As shown in FIGS. 4 and 5, when the switch 5 pivots counter clockwise, the operation member 4 is pivoted counter clockwise so that the first and second rods 41, 42 are pivoted counter clockwise. The bead 71 is engaged with the other recess 84 on the right. The second rod 42 drives the resilient member 6 to push the engaging member 3 on the right to move upward so that the teeth 31 of the engaging member 3 on the right are engaged with the ratchet teeth 21 of the driving member 2. In the meanwhile, the first rod 41 pushes the engaging member 3 on the left move downward and the teeth 31 of the engaging member 3 on the left are disengaged from the ratchet teeth 21 of the driving member 2. When rotating the ratchet wrench clockwise, the right wall of the space 10 contacts the outside of the engaging member 3 on the right, so that the teeth 31 of the engaging member 3 on the right are engaged with the ratchet teeth 21 of the driving member 2 as shown in FIG. 4. The driving member 2 rotates clockwise to output torque. On the contrary, When rotating the ratchet wrench counter clockwise, the right wall of the space 10 is separated from the outside of the engaging member 3 on the right, and the second rod 42 on the right compresses the resilient member 6 to separate the engaging member 3 on the right from the driving member 2, no torque is output as shown in FIG. 5.

The switching device is easily to be assembled to the ratchet wrench and improves the shortcomings of the conventional switching device.

While we have shown and described the embodiment in accordance with the present invention, it should be clear to those skilled in the art that further embodiments may be made without departing from the scope of the present invention.

What is claimed is:

1. A ratchet wrench comprising:

a handle and a head connected to the handle, a board connected to one side of the head and a space defined in the head, a first hole and a second hole defined through the board, a fixing portion formed in an inner periphery of the space;

a driving member having a cylindrical portion on one end thereof and a polygonal portion on the other end of the driving member, multiple ratchet teeth formed to an outer periphery of the driving member, the driving member located in the space and the cylindrical portion engaged with the first hole;

two engaging members located in the space and each having teeth which are engaged with the ratchet teeth of the driving member, each engaging member having a slot defined therethrough;

an operation member located in the space and having a shank extending from one end thereof, a first rod, a second rod and a positioning tube extending from the other end of the operation member, the first and second rods respectively extending through the two slots of the two engaging members, the first rod having a first positioning portion and the second rod having a second positioning portion, the first rod, the second rod and the positioning tube being located not sharing an axis of the shank, the shank extending through the second hole of the board;

a switch having a connection portion and a lever, the switch located on outside of the board and the shank securely connected to the connection portion;

two resilient members respectively in the slots, each resilient member being biased between the first/second positioning portion and an inner periphery of the slot;

a positioning unit having a spring and a bead, the spring located in the positioning tube and the bead being biased by the spring;

a cover connected to the other side of the head to seal the space and having a flange on a periphery thereof, an accommodation hole defined through the cover and the polygonal portion of the driving member extending through the accommodating hole, the cover having two recesses defined in an inside thereof, the bead being engaged with one of the two recesses, and a locking member engaged with the fixing portion of the space and pressing on the flange of the board.

2. The wrench as claimed in claim 1, wherein the connection portion of the switch is a polygonal recess and the shank is a polygonal protrusion which is securely engaged with the polygonal recess.

3. The wrench as claimed in claim 2, wherein a fixing member extends through the switch and is fixed to the shank.

4. The wrench as claimed in claim 1, wherein the first rod has a first flat face and the second rod has a second flat face, the first positioning portion is defined in the first flat face and the second positioning portion is defined in the second flat face.

5. The wrench as claimed in claim 1, wherein the slot of each engaging member is an elongate slot.

6. The wrench as claimed in claim 1, wherein the locking member is a C-shaped clip.

* * * * *